United States Patent [19]

Dugan

[11] Patent Number: 4,516,354

[45] Date of Patent: May 14, 1985

[54] COUNTERWEIGHT DOOR STRUCTURE

[76] Inventor: J. Joseph Dugan, Box 127, Greeley, Nebr.

[21] Appl. No.: 552,250

[22] Filed: Nov. 16, 1983

[51] Int. Cl.[3] ..... E05F 1/00

[52] U.S. Cl. ..... 49/387

[58] Field of Search ..... 49/387, 386, 197, 200, 49/206, 203, 198

[56] References Cited

U.S. PATENT DOCUMENTS

| | | | |
|---|---|---|---|
| 1,187,635 | 6/1916 | McCormack | 49/198 |
| 2,664,597 | 1/1954 | McKee | 49/203 |
| 2,718,036 | 9/1955 | Strobel | 49/200 |
| 2,854,707 | 10/1958 | Hieatt | 49/200 |
| 2,863,181 | 12/1958 | Josephson | 49/387 |
| 3,175,761 | 3/1965 | Moore | 49/387 X |
| 3,421,260 | 1/1969 | Dickinson | 49/203 |
| 4,014,133 | 3/1977 | Brown | 49/197 |
| 4,165,897 | 8/1979 | Schmidt | 49/386 X |
| 4,334,389 | 6/1982 | Visser | 49/387 |

FOREIGN PATENT DOCUMENTS

| | | | |
|---|---|---|---|
| 746119 | 2/1933 | France | 49/387 |
| 1017058 | 12/1952 | France | 49/387 |

*Primary Examiner*—Philip C. Kannan

*Attorney, Agent, or Firm*—Zarley, McKee, Thomte, Voorhees & Sease

[57] ABSTRACT

A counterweight door structure includes a door having a pair of upwardly extending arms for supporting counterweights at positions in spaced relation above the top edge of the door. The door is mounted for pivotal movement about a generally horizontal axis positioned closely adjacent the top edge of the door and the top edge of the door opening. The counterweight support arms are laterally spaced apart by a distance greater than the width of the building adjacent the door pivot axis to provide swinging clearance for the support arms when the door is pivoted upwardly 90°.

9 Claims, 5 Drawing Figures

COUNTERWEIGHT DOOR STRUCTURE

BACKGROUND OF THE INVENTION

The present invention is directed generally to a counterweight door structure and more particularly to a large swinging door pivotal about an axis adjacent the upper edge thereof and having reinforced upwardly extended arms carrying counterweights in spaced relation from the top of the door.

Large doors which are supported for pivotal movement about a horizontal axis are known for airplane hangars and the like, as described in U.S. Pat. No. 2,863,181. The pivot axis for such doors, however, was situated in spaced relation below the top of the door opening to provide swinging clearance for the counterweight situated along the upper edge of the door. Thus full utilization of the door opening area was not available.

In modern airplane hangars and storage buildings for agricultural and construction equipment, it is helpful to provide a door opening of a size which occupies substantially an entire side or end of the building. It is furthermore desirable to provide a door which is movable from a closed position wherein it covers the door opening to an open position wherein the entire door opening is substantially unobstructed. For very larges doors, materials required for structural integrity by conventional construction would generally result in a door which is too heavy or expensive for practical applications.

Accordingly, it is a primary object of the invention to provide an improved counterweight door structure.

Another object is to provide a counterweight door structure having counterweights supported on upwardly extended arms at positions spaced above the top edge of the door.

Another object is to provide an improved counterweight door structure having a forwardly extended truss or reinforcement system for the counterweight support arms.

Another object is to provide an improved counterweight door structure wherein the counterweights are situated a substantial distance from the pivot axis of the door for increased leverage.

Another object is to provide an improved counterweight door structure wherein the upwardly extended counterweight support arms are spaced-apart by a distance greater than the width of the building so as to provide swinging clearance for the counterweights when the door is pivoted upwardly at least 90°.

Another object is to provide a counterweight door structure which is simple in construction, economical to manufacture, easy to install and efficient in operation.

SUMMARY OF THE INVENTION

The counterweight door structure of the present invention includes a door having one or more upwardly extending arms for supporting counterweights at positions in spaced relation above the top edge of the door. The door is mounted for pivotal movement about a generally horizontal axis positioned closely adjacent to the top edge of the door. Thus when the door is pivoted upwardly to a horizontal position, substantially the entire door opening is clear for passage of vehicles and loads into and from the building.

The counterweight support arms may be provided as integral extensions of vertical frame members of the door and a forwardly extended truss on the arms and door enables the support arms to be constructed of substantially lighter weight materials than would be required without the additional truss support.

The upwardly extended counterweight support arms are laterally spaced-apart by a distance greater than the width of the building adjacent the door pivot axis so that when the door is pivoted upwardly at least 90°, swinging clearance is provided for the counterweights on both sides of the building.

The truss reinforcement system enables the counterweights to be supported at a position substantially above the top edge of the door. The leverage afforded by this arrangement enables a relatively smaller counterweight to operatively open the door. The relatively lighter weight construction and lighter counterweights required by the door system of the present invention result in a strong, durable, yet economical counterweight door structure.

DESCRIPTION OF THE PREFERRED EMBODIMENT

Figure 1:
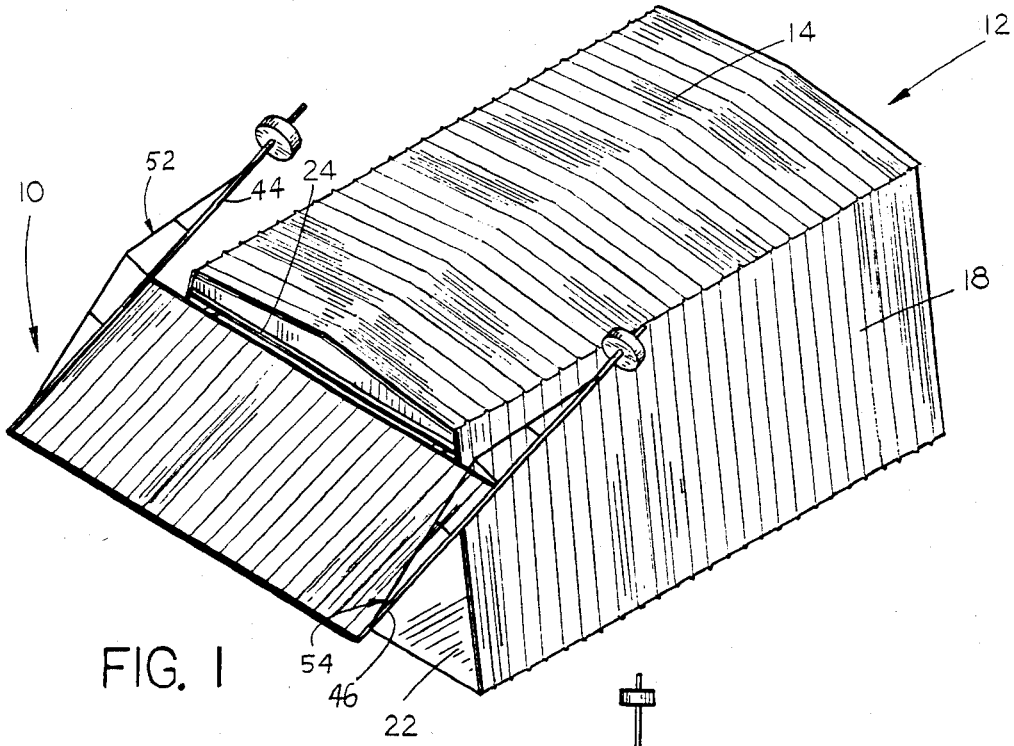
FIG. 1 is a perspective view of a building with the counterweight door structure of the invention installed thereon.
Figure 2:
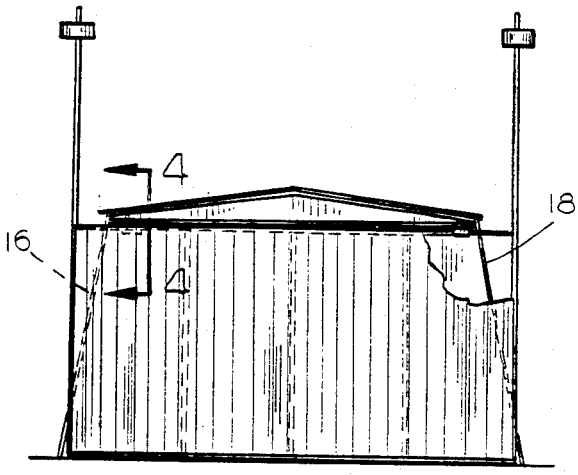
FIG. 2 is a front elevational view of the building and door structure.

The counterweight door structure 10 of the present invention is shown in FIG. 1 in assembly relation with a building 12. Building 12 is shown as a large rafter type agricultural storage building, sometimes referred to as a pole barn. Building 12 includes a roof 14 supported on opposite side walls 16, 18 and rear wall 20. The front side of the building is substantially completely open to define a door opening 22. In FIG. 2 it is seen that the side walls 16 and 18 are inclined upwardly and inwardly so that the building width at ground level exceeds the building width at the upper edge 24 of door opening 22.

Figure 5:
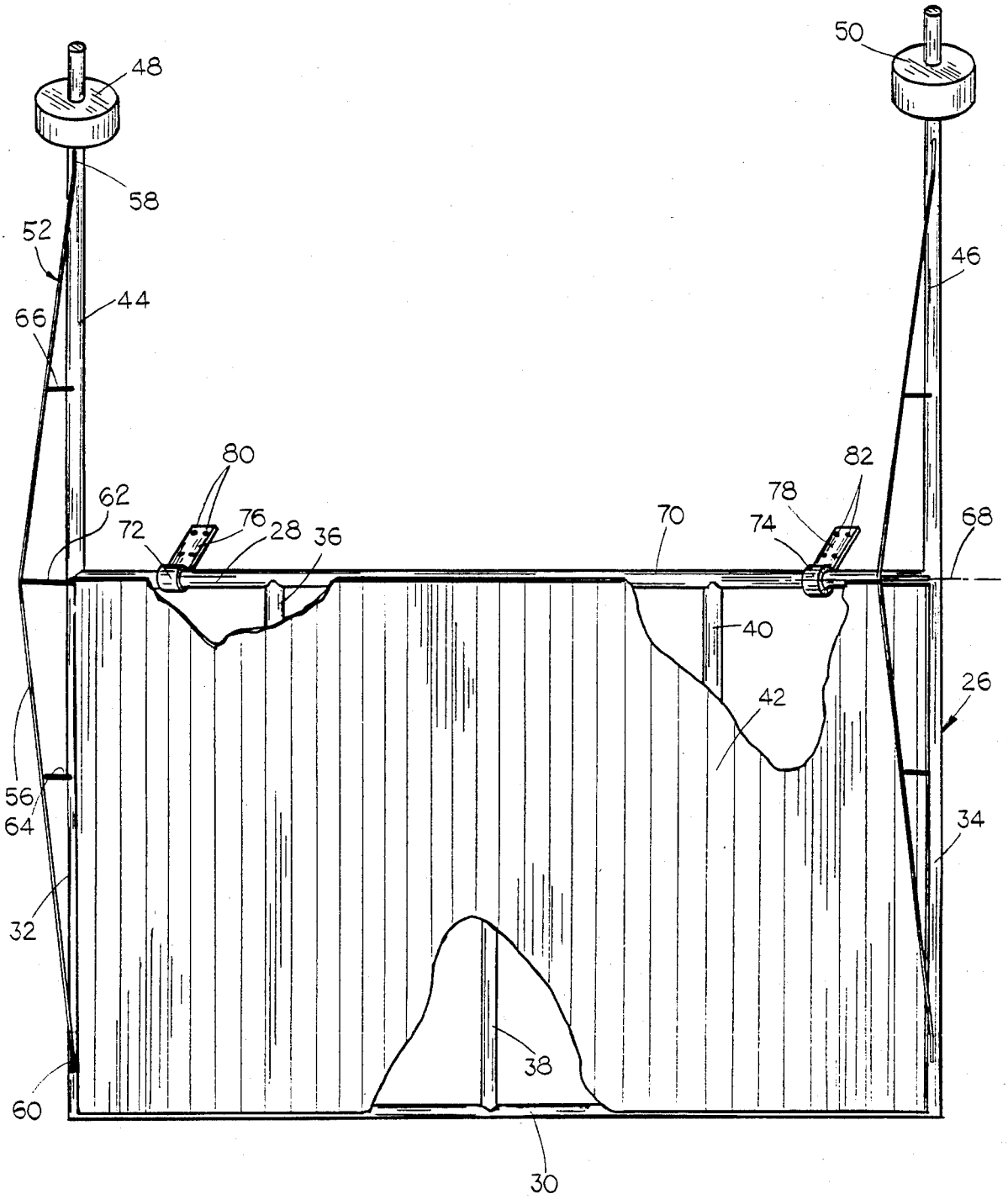
FIG. 5 is a perspective view of the door structure of the invention with portions broken away for clarity.

The structure of the counterweight door structure 10 is evident in FIG. 5 which shows a door 26 defined by a top cross bar 28, a bottom cross bar 30 and upright opposite side frame members 32 and 34 which are connected to and extended between the opposite ends of the top cross bar and bottom cross bar. A plurality of additional upright frame members 36, 38 and 40 interconnect top cross bar 28 and bottom cross bar 30 for added strength and rigidity. A door panel or covering 42 substantially covers the exterior surface of door 26.

A pair of counterweight support arms 44 and 46 are connected to the door and extended upwardly therefrom. Preferably, the counterweight support arms 44 and 46 are integral aligned extensions of side frame members 32 and 34. A pair of counterweights 48 and 50 are supported on arms 44 and 46 respectively adjacent the upper ends thereof. In other embodiments, a single counterweight support arm may be provided on one end of the door or at any other position therealong and the counterweight may be supported at any selected position along the support arm. The counterweights are shown as annular solid metal disks but other shapes of counterweights could be substituted so long as they are capable of being rigidly mounted on the upper ends of the support arms 44 and 46.

To strengthen the overall door and support arms 44 and 46 when the door structure 10 is pivoted upwardly to a horizontal position as shown in FIG. 1, a forwardly extended truss 52 is provided on counterweight support arm 44 and door side frame member 32. Truss 52 spans most of the height of the door and support arm 44. A similar truss 54 is provided on support arm 46 and side frame member 34. For clarity, only truss 52 will be described in detail since both trusses are identical.

Truss 52 includes an elongated tension member 56 having upper and lower ends 58 and 60 which are welded or otherwise secured to the support arm 44 and side frame member 32 respectively. Tension member 56 may be a steel rod, angle iron or some other rigid member. The length of rod 56 is somewhat greater than the straight line distance between the secured ends of the rod. The added length of the rod enables it to be spaced forwardly from the support arm 44 and side frame member 32 by a central spacer link 62 and shorter spaced-apart spacer links 64 and 66. In the raised position of the door as shown in FIG. 1, the truss affords added strength for the support arm 44 and side frame member 32 which would otherwise be provided only if these members were constructed of substantially heavier and more expensive material.

Door 26 is mounted on the front wall of building 12 for pivotal movement of the door about a generally horizontal pivot axis 68 located closely adjacent the top edge 70 of door 26 and closely adjacent the top edge 24 of door opening 22.

In the preferred embodiment, the top cross bar 28 of door 26 is cylindrical. It is pivotally received with a pair of support sleeves 72 and 74 which include rearward extension plates 76 and 78 respectively. Plates 76 and 78 include a plurality of bolt holes 80 and 82 which are alignable with similar holes in the lower flange 84 of horizontal beam 86 which defines the upper edge 24 of door opening 22. Bolts 88 are inserted through the aligned holes and are engaged therein by nuts 90 to securely support the sleeves 72 and 74 at the top edge of the door opening.

In other embodiments, the top cross bar 28 and other door frame members may be formed of wood, square section tubing or other elongated structural members.

Figure 4:
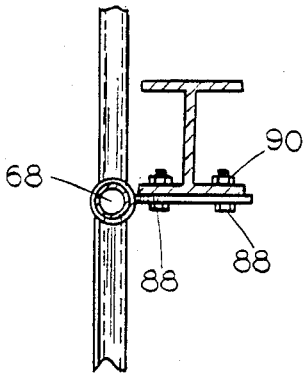
FIG. 4 is an enlarged detail section view taken along line 4—4 in FIG. 2.
Figure 3:
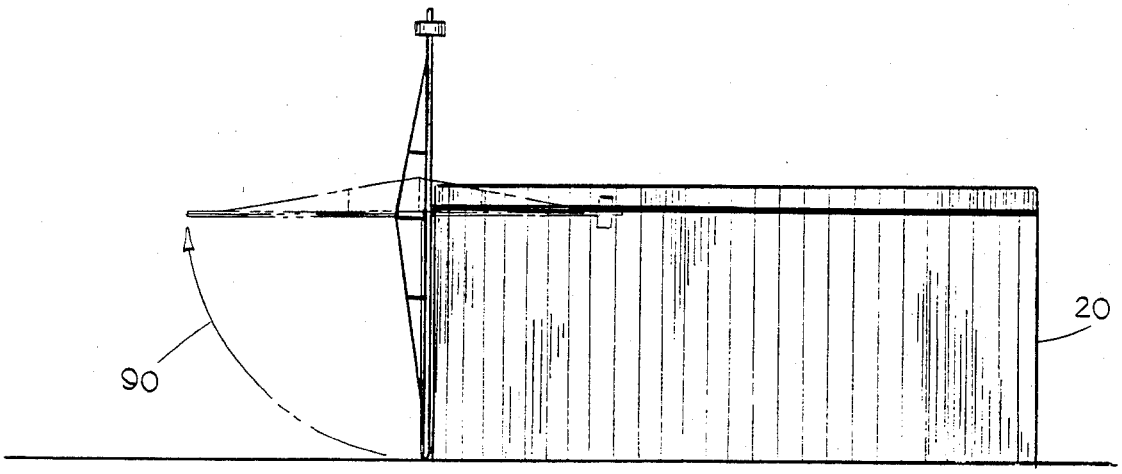
FIG. 3 is a side elevational view of the building and door structure with dotted lines indicating the moved position of the door structure.

In FIG. 4, it is seen that the horizontal pivot axis 68 for door 26 is disposed substantially right at the height of the upper edge of the door opening. Since it runs right through the door top cross bar 28, it is also therefore situated closely adjacent the top edge 70 of the door. Thus, when the door is pivoted forwardly and upwardly, as indicated by arrow 90 in FIG. 3 to the dotted line horizontal open position, substantially the entire door opening is available for the passage of vehicles or loads into and from the building.

To provide swinging clearance for the counterweights 48 and 50, the transverse spacing between the counterweight support arms 44 and 46 exceeds the width of the door opening 22 adjacent the upper edge 24 thereof. Similarly, the transverse spacing between the counterweight support arms 44 and 46 exceeds the width of the building at the height of pivot axis 68 so that, upon pivotal movement of the door structure 10 from the substantially vertical solid line closed position of FIG. 3 to the substantially horizontal raised dotted line position, the counterweight support arms 44 and 46 are pivotally moved to positions exteriorly of the building side walls 16 and 18 and below the top edges of the side walls. This feature is facilitated by the trapezoidal cross sectional shape of building 12. For vertical sided buildings of generally rectangular cross section, the same capability could be achieved by simply providing an oversized door which extends somewhat beyond the building side walls on both sides. Likewise, the arms of a smaller door may be shaped so as to meet the important design criteria that they be arranged in noninterfering relation with the building upon pivotal movement of the door to a substantially horizontal raised position.

The counterweight door structure 10 of the present invention lends itself to very large door sizes. Doors of up to 52 foot width have been successfully installed. The combined weight of counterweights 48 and 50 and support arms 44 and 46 should relate to the weight of door 26 below the pivot axis 68 so that the door can be swung between its open and closed positions with very little effort.

Whereas a preferred embodiment of the invention has been shown and described herein, it will be apparent that many modifications, substitutions and alterations may be made which are within the intended broad scope of the appended claims.

For example, whereas the top cross bar of the door may be provided as a $3\frac{1}{2}$ inch tube pivotally received within 4 inch sleeves for a relatively tight fit, $4\frac{1}{2}$ inch sleeves may alternately be used with a piece of belting wrapped around the top cross bar to provide a fabric bearing which eliminates squeaking and friction. If the belting is oiled up, the door will pivot easily.

Furthermore, the building may be provided with a saddle structure adapted to receive the counterweight or counterweight support arm when the door is moved to its raised position to thereby prevent continued pivotal movement beyond the selected raised position. Preferably, the door is pivoted upwardly just slightly less than 90° in its raised position to avoid encountering lift forces due to wind.

Thus there has been shown and described a counterweight door structure which accomplishes at least all of the stated objects.

I claim:

1. A counterweight door structure, comprising, a door having a top edge, bottom edge and opposite side edges, at least one arm connected to said door and extended upwardly therefrom, a counterweight carried on said arm at a position in spaced relation from said door, door mounting means on said door for supporting said door for pivotal movement about a horizontal axis positioned closely adjacent the top edge of the door, and a forwardly extended truss on said arm and said door, said truss spanning a substantial portion of the height of the door and arm, said truss comprising an elongated tension member having upper and lower ends, means for securing said upper end of the tension member to said arm, means for securing said lower end of the tension member to said door and a plurality of spacer links arranged in spaced-apart relation along said arm and door and connected to said tension member.

2. The structure of claim 1 wherein said truss is substantially vertically centered relative to said horizontal axis.

3. The structure of claim 1 further comprising a second arm connected to said door and extended upwardly therefrom and a second counterweight carried on said second arm.

4. The structure of claim 3 wherein said counterweights are carried adjacent the upper ends of said arms.

5. The structure of claim 4 wherein each arm is substantially as long as the height of said door and includes upper and lower ends.

6. The structure of claim 3 wherein said door includes forward and rearward surfaces and a plurality of upright frame members, each arm comprising an extension of a respective frame member.

7. The structure of claim 6 wherein said door comprises a peripheral frame including a pair of upright side frame members and top and bottom cross members connected to and extended between said side frame members, said arms being integral extensions of said side frame members.

8. The structure of claim 7 wherein said top cross member is cylindrical and said coacting mounting means comprises a pair of support sleeves through which said top cross member is rotatably received and means for supporting said sleeves on a building.

9. In combination, a building including a door wall having a door opening therein, said door opening having a top edge and opposite side edges, a door of a size and shape to substantially cover said door opening, said door having a top edge, a bottom edge and opposite side edges, at least one arm rigidly connected to said door and extended upwardly therefrom, a counterweight carried on said arm at a position in spaced relation from said top edge of the door, coacting mounting means on said door and building for supporting said door on said building for pivotal movement of said door about a generally horizontal pivot axis located closely adjacent said top edge of the door and closely adjacent said top edge of said door opening, a second arm rigidly connected to said door and extended upwardly therefrom and a second counterweight carried on said second arm, the spacing between said arms exceeding the width of said door opening adjacent the top edge of said opening, and said building including a building portion situated rearwardly of said door wall and at least partially defined by a pair of opposite side walls connected to opposite ends of said door wall, the spacing between said pair of arms exceeding the width of said building portion whereby, upon pivotal movement of said door from a substantially vertical closed position to a substantially horizontal raised position, said arms are situated exteriorly of and below the top edges of said side walls.

* * * * *